US006397900B1

(12) United States Patent
Sautter et al.

(10) Patent No.: US 6,397,900 B1
(45) **Date of Patent: *Jun. 4, 2002**

(54) APPARATUS FOR SHAPING WIRE INTO WIRE PRODUCTS

(75) Inventors: Dietmar Sautter, Lichtenstein; Andreas Schur, Dettingen/Erms; Norbert Speck, Reutlingen-Altenburg, all of (DE)

(73) Assignee: Wafios Maschinenfabrik GmbH & Co. Kommanditgesellschaft, Reutlingen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/577,630

(22) Filed: May 24, 2000

Related U.S. Application Data

(62) Division of application No. 09/085,082, filed on May 26, 1998, now Pat. No. 6,092,565.

(30) Foreign Application Priority Data

Apr. 11, 1998 (DE) ..... 198 16 403

(51) Int. Cl.[7] ..... B21F 45/00
(52) U.S. Cl. ..... 140/71 R; 72/131
(58) Field of Search ..... 140/71 R; 72/307, 72/403, 131

(56) References Cited

U.S. PATENT DOCUMENTS

| | | | | |
|---|---|---|---|---|
| 3,698,448 | A | 10/1972 | Spuhl | 140/3 |
| 4,187,889 | A | 2/1980 | Hametner et al. | 140/92.1 |
| 4,399,842 | A | 8/1983 | Gibbons | 140/92.1 |
| 4,523,447 | A | 6/1985 | Sticht et al. | 72/144 |
| 4,680,950 | A | 7/1987 | Ohdai et al. | 72/130 |
| 5,105,641 | A | 4/1992 | Veit | 72/137 |
| 5,184,651 | A | 2/1993 | Gawa et al. | 140/115 |
| 5,363,681 | A | 11/1994 | Speck et al. | 72/129 |
| 5,647,405 | A | 7/1997 | Fichtner et al. | 140/92.1 |

FOREIGN PATENT DOCUMENTS

| | | |
|---|---|---|
| DE | 8915888 U1 | 11/1989 |
| DE | 19736468 A1 | 2/1998 |

*Primary Examiner*—Allen Ostrager
*Assistant Examiner*—William Hong
(74) *Attorney, Agent, or Firm*—Renner, Otto, Boisselle & Sklar, LLP

(57) ABSTRACT

In order to control, in a wire shaping apparatus with a rotatable wire intake device (10), friction of the wire at the bore wall of a wire holder (52) which finally leads the wire towards the shaping station, and in order to reduce it to zero if necessary, it is suggested to provide said apparatus, the wire holder (52) of which can be rotated programmably controlled about the wire axis, with a remote controllable wire brake device (114) which acts radially upon the wire being fed along, and the wire brake device is programmably controlled.

9 Claims, 2 Drawing Sheets

APPARATUS FOR SHAPING WIRE INTO WIRE PRODUCTS

This is a division of application Ser. No. 09/085,082, filed May 26, 1998, now U.S. Pat. No. 6,092,565.

BACKGROUND OF THE INVENTION

The invention relates to an apparatus for shaping wire.

Apparatus for shaping wire is disclosed in U.S. Pat. No. 5,363,681 (WAFIOS FTU 3). This apparatus has a flange (118) which is firmly attached to the bearing body and is provided with a prismatic part (140) on which a radially adjustable wire guide attachment (136) is provided which has an eccentric wire guide bore (137) and which cooperates with a cutting tool (14). The wire guide (130) ending at the attachment (136) always rotates synchronously with the intake roller pairs about the wire axis. This apparatus has already been modified in such a way that the prismatic part at the now rotatable flange, as one unit together with the wire holding attachment, can be guided in a circular movement around the wire axis so that the friction between the wire and the attachment can be eliminated. This is also suggested by DE 197 36 468 A1 (ITAYA) in which, however, the stationary wire guide (80) between the stationary wire intake rollers (14 and 15) on the one hand, and the rotatable wire holder (70) on the other hand, generates friction when the wire is twisted about its lengthwise axis.

A particularity of DE 197 36 468 A1 is a remote controlled rotatable wire grip (64) provided at the rotatable wire guide (70) for non-rotatable clamping of the wire whereby said wire guide can not turn the wire about its own axis like clamping intake rollers do.

SUMMARY OF THE INVENTION

It is the object of the present invention to considerably improve the geometric shape accuracy of the three-dimensional wire bodies produced by the apparatus for shaping wire disclosed by U.S. Pat. No. 5,363,681 and this with an unchanging result, and to increase the output of the apparatus, i.e. to achieve a quality increase of finished workpieces and a performance increase of the apparatus for shaping three-dimensional workpieces.

This is achieved by the invention at first by the fact that the outlet wire guide installed rigidly at the bearing body of the rotatable wire intake device of the apparatus for shaping wire according to U.S. Pat. No. 5,363,681 is replaced by a known rotatable wire guide, and secondly, that the rotatable wire guide is equipped according to this invention with a programmably controlled and power controlled wire "braking" device, the shaping process servomotor of which is controlled by the machine control together with the servomotors of the other device aggregates of the apparatus.

Due to the common but separately arranged 'rotating wire intake' and 'rotating wire guide' the azimuthal friction during a synchronous run is completely eliminated, since no relative movement between the wire intake and the wire guide takes place when the wire is turned. This is of special advantage, because the friction between the wire and the wire guide during the shaping process leads to inaccuracies in the workpiece geometry. Further, 'unlimited' turning of the wire (to-and-fro) is possible even when the wire guide stands.

It goes without saying that the rotating wire intake and the rotating wire guide can also be operated asynchronously.

The aforementioned advantage of friction elimination can be optimized by the wire brake device according to the invention which operates programmably controlled and power controlled in each individual section of operation of the workpiece to be produced. The braking pressure on the wire can be programmably controlled in such a way that during the shaping process, for example, when an already finished part of the workpiece in the wire shaping area turns down, a damping effect is generated. Or with an appropriate programmably controlled brake pressure, a supporting or stabilizing effect can be obtained during shaping operations of the standing wire so that the wire and, if necessary, its already finished portion can not twist in its angular position. Further, the brake pressure on the incoming wire can be determined by the computer in such a way that, for example, during winding the play between the incoming wire and the wire guide is reduced so precisely that an exact spring form and spring pitch is obtained during the winding process, whereas feeding of the wire is still possible.

Thus it will be possible to compensate for too much play between the wire and the guide resulting, for example, from wear of the wire guide (enlarged wire guide bore), or from too much play resulting from wire diameter tolerances.

These improvements on every individual production section will considerably increase the quality of the finished workpieces and this in a constant way even for large scale manufacturing.

BRIEF DESCRIPTION OF THE DRAWINGS

In the following text the invention will be explained in detail with reference to the preferred embodiment of the apparatus according to the invention illustrated by way of an example shown schematically in the drawings in which.

DETAILED DESCRIPTION

Figure 1:
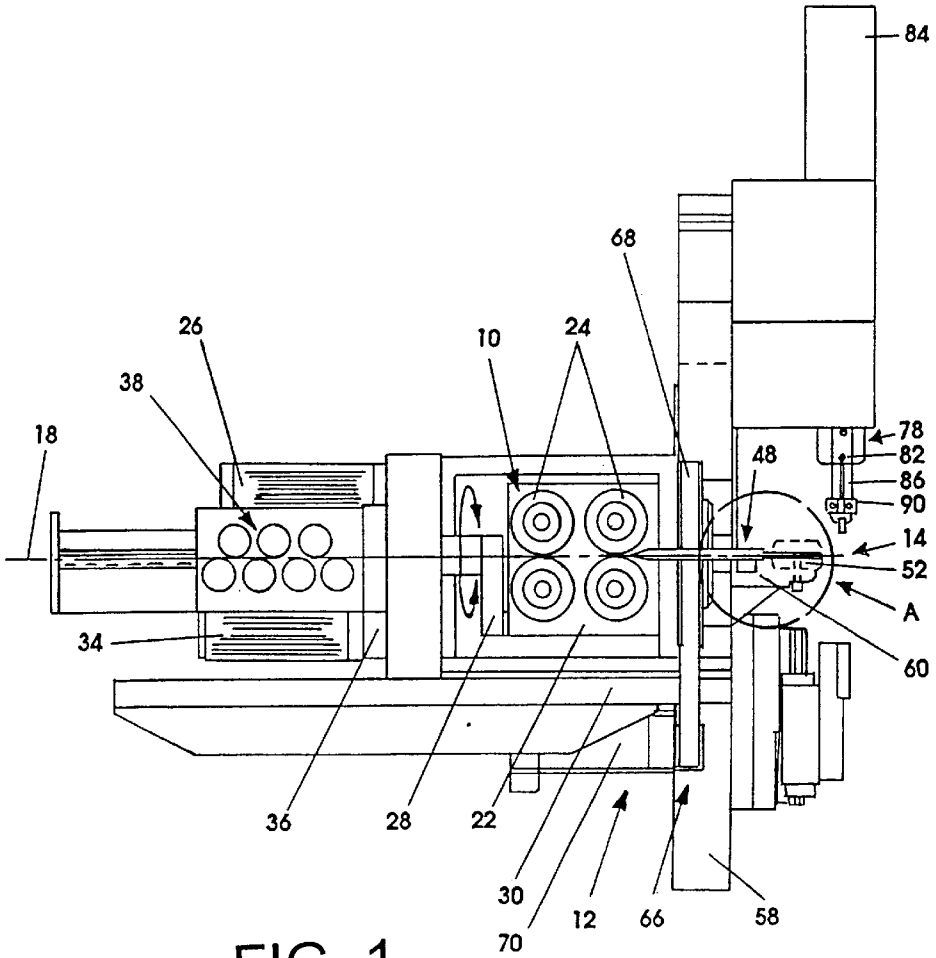
FIG. 1 is a side view of the embodiment partly broken away

FIG. 1 shows a rotatable wire intake device 10, a rotatable wire guide device 12 with a wire brake device 114 (FIG. 3), a wire shaping station 14 and a cutting device 16 (FIG. 2) for cutting a certain workpiece length from the endless wire 18, all of a CNC-controlled apparatus for shaping wire.

The used rotatable CNC-controlled wire intake device 10 for intermittent feed of the wire 18 into the wire shaping station 14 and for CNC-controlled twisting of the wire 18 about a predetermined angular value is that disclosed by U.S. Pat. No. 5,363,681.

However, the known CNC-controlled rotatable wire intake device 10 disclosed by U.S. Pat. No. 5,363,681 comprises an intake housing 22 in which a total of four wire intake rollers 24 are rotatably mounted to push the wire 18 forwards into the wire shaping station 14. The rollers 24 are arranged pairwise and are driven intermittently and are programmably controlled, and are speed controlled, to rotate selectively forwards and backwards, by a first CNC controllable servomotor 26 by means of two toothed belt transmissions of which only one 28 is shown here.

In order to turn the intaken wire 18 clamped between the wire intake rollers 24, the intake housing 22 of the wire intake device 10 itself is rotatably mounted on a bearing body 30 attached to the apparatus for shaping wire. The intake housing 22 is driven intermittently, is programmably controlled, and is rotated selectively forwards and backwards, by a second controllable servomotor 34 by means of a toothed belt transmission 36.

On the left side of FIG. 1, the wire intake side of the rotatably mounted intake housing 22, a usual wire straightening device 38 with horizontally and vertically arranged straightening rollers is attached to the intake housing extension to straighten the wire 18 before it is introduced between the intake rollers 24 after passing through the intake housing 22.

On the right front side of the bearing body 30 of FIG. 1, a two-part wire guide 48 consisting of an upper part 42 and a lower part 44 and supported by the intake housing 22 is mounted rotatably on the bearing body 30 as part of the wire guide device. The wire guide 48 extends to the left until the outlet of the right wire intake roller pair and to the right as it approaches an eccentric wire holder 52.

The wire holder 52 is part of a rotatable wire guide device 12. This latter further comprises a cantilever 60 on a rotatable flange 62 (FIG. 3) which outside the front plate 58 of the machine frame is rotatable in roller bearings in the plate 58 about the wire axis and is screwed onto the plate 58 with a crown gear 64 (FIG. 3) of a toothed belt drive 66. The crown gear 64 is driven by means of a toothed belt 68 of a toothed belt drive 66 by a third CNC controllable servomotor 70 programmably controlled, intermittently rotated selectively forwards and backwards.

The wire holder 52 which is positioned axially in front of the front outlet of the wire guide 48 which rotates together with the wire intake device 10, is detachably fixed onto the free end of the cantilever 60.

Figure 3:
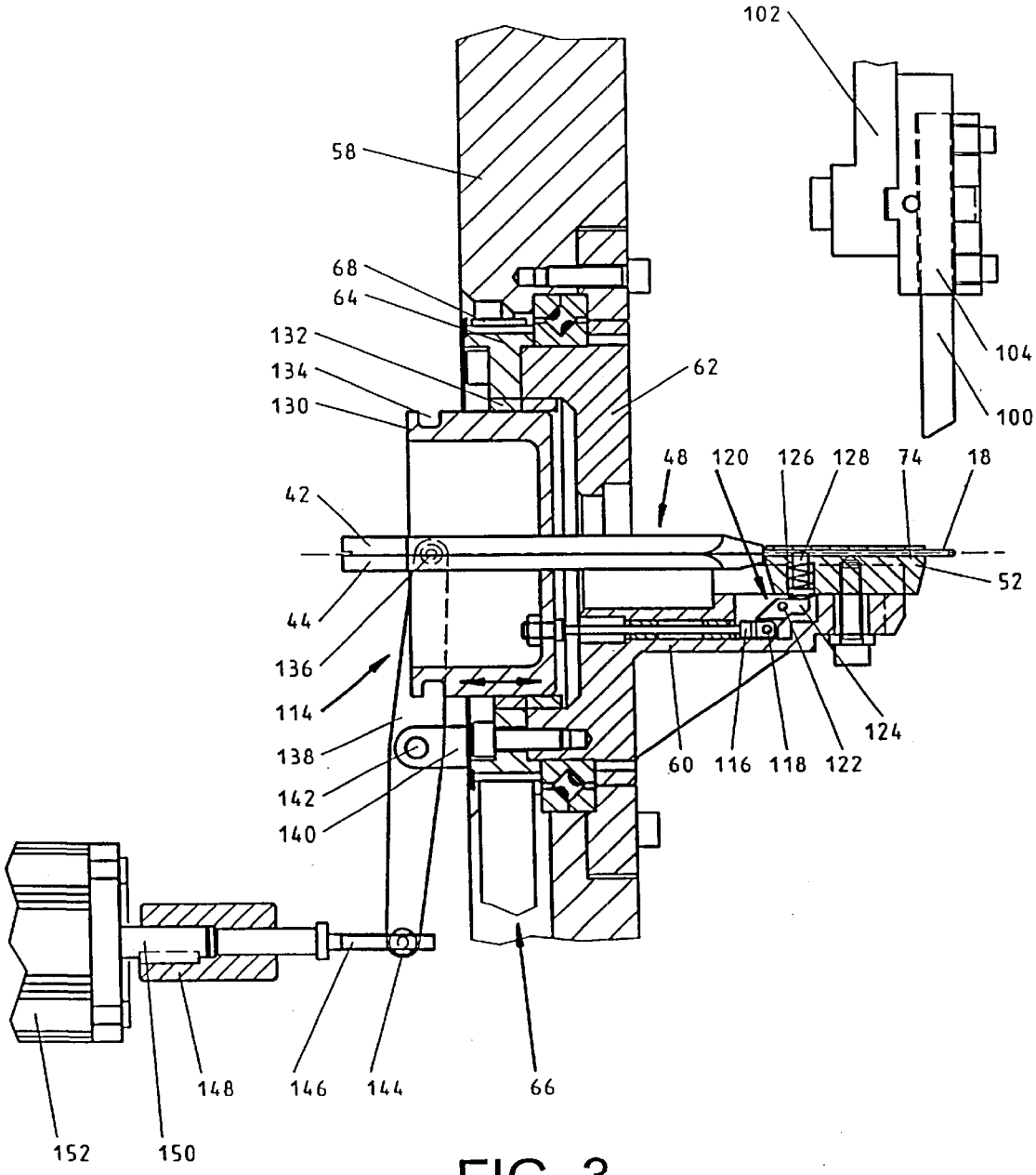
FIG. 3 is a magnification, partly in section, of detail A of FIG. 1.

In order to actuate the wire brake device 114, a tow bar 116 is guided slidingly in the cantilever 60 of the rotatable wire guide device 12 (see FIG. 3). One end of the tow bar 116 is connected with a two-armed lever 120 by means of a bolt 118. The lever 120 pivots around a bolt 122 in the cantilever 60. The free lever arm 124 of the lever 120 presses the rounded end of a pressure bolt 128 under prestress by means of a pressure spring 126 guided slidingly in the (two-part-type) wire holder 52, said pressure bolt 128 having a prismatic recess at its other end. This prismatic end of the bolt 128 cooperates with the passing-by wire 18 whereby friction forces are converted into brake forces.

The end of the tow bar 116 opposite the lever 120 is firmly connected with a switching ring 130. The switching ring 130 is mounted axially displaceably in a slide bushing 132, but is held in the bushing 132 radially and is not twistable. So in case of a rotating movement of the flange 62, the switching ring 130 follows this rotation. The switching ring 130 has a groove 134 at its outer circumference into which the two switching claws 136 (one shown) of a two-armed switching lever 138 engage. The switching lever 138 is mounted approximately centrally in a bearing 140 pivoting on a bolt 142. The bearing 140 is firmly connected to the front plate 58.

The arm of the switching lever 138 opposite the switching claws 136 is provided with a lever eye 144 with an internal thread into which a threaded spindle 146 is screwed. The threaded spindle 146 is connected non-rotatably by means of a coupling 148 with the shaft end 150 of a CNC controllable servomotor 152.

For the shaping process of the fed wire, the holder 52 can be brought into the most favorable position for this by means of the rotatable wire guide device 12, for example, in order to allow a turndown of the partly finished workpiece or in order to turn the wire holder 52 into such a position that when the finished workpiece is cut off the endless wire, the cutting knife 100 of the cutting device 16 cuts the wire 18 against the higher wall thickness of the holder 52 which simultaneously serves as a counterknife.

Figure 2:
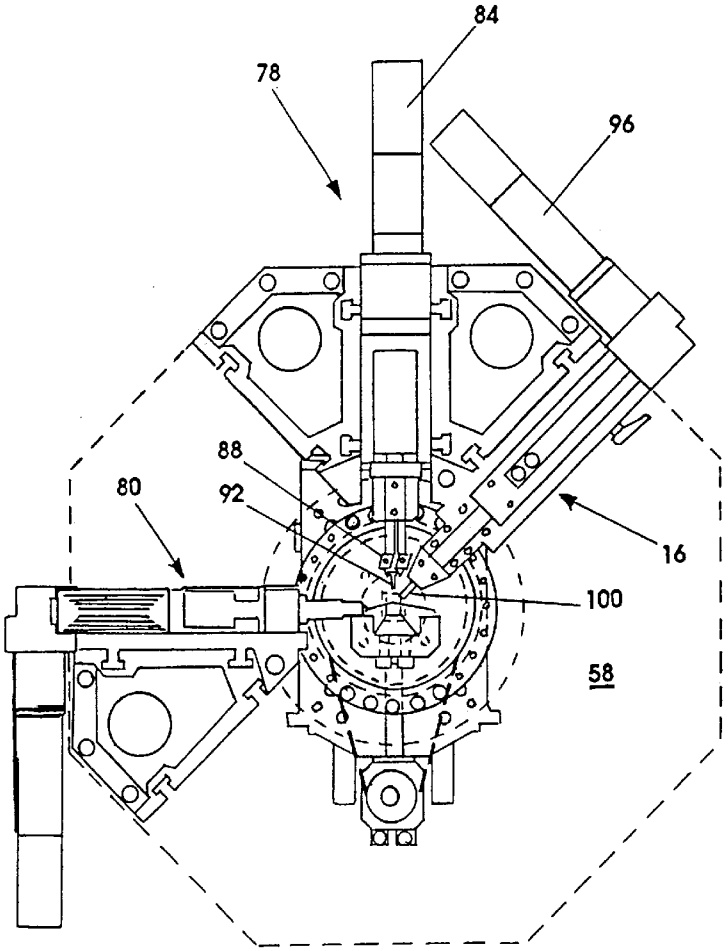
FIG. 2 is a front view of a portion of the embodiment shown in FIG. 1

The wire shaping station 14 is located at the front plate 58 which simultaneously is the shaping side of the apparatus for shaping wire. It comprises several processing units fixed radially around the wire guide bore 74 of the wire holder 52. In FIG. 2 three of these units are shown: a winding/bending unit 78, a CNC twisting unit 80, and a CNC slide unit belonging to the cutting device 16. The winding/bending unit 78 is described in detail in U.S. Pat. Nos. 5,363,681 and 5,105,641. In FIG. 1, on the right side of the wire holder 52 a vertical shaft 80 of the winding/bending unit 78 is provided vertical to the wire feeding device which is driven rotatably by a fourth CNC controllable servomotor 84 whereby the degree of shaft rotation, the sense of rotation, and the standstill can be freely selected. In order to allow the shaft 80 to carry out, in addition to its rotating movement, if necessary, a simultaneous longitudinal displacement, another CNC controllable servomotor (not shown) is foreseen. The amount of the longitudinal displacement of the shaft 82 is also freely selectable by the CNC control.

At the bottom end of the shaft 82, in a conical support, a tool holder 86 known from U.S. Pat. No. 5,105,641 is fixed rigidly but detachably which can bear several tools arranged around its circumference and distributed over its length. In the embodiment shown as an example these are two winding tools 88 (FIG. 1) and 90 (FIG. 2) with several operating zones for the wire 18 as well as a bending tool 92 (FIG. 2).

The slide unit belonging to the cutting device 16 is driven by another CNC controllable servomotor 96 by means of a crank drive (not shown) and a connecting rod (not shown). The cutting knife 100 is held exchangeably in a support 104 at the free end of the cutting slide 102 guided lengthwise displaceably in a slide guide of the cutting device 16.

The mode of operation of the apparatus according to the invention with reference to the embodiment shown in the example is as follows:

When the fist servomotor 26 is activated, the straightened endless wire 18 stretched between the intake rollers 24 is intermittently moved forward horizontally in a straight line through the wire guide 48 and the holder 52 by means of the CNC controlled intake rollers 24 to enter the wire shaping station 14 where it is formed according to the tools which become active on the tool holder 86. CNC controlled withdrawal of the wire is also possible by reversal of the sense of rotation of the motor.

Bringing the individual tools into position before the shaping process and the active movement of the tools for the shaping of the workpiece are brought about by CNC activation of the servomotors of the winding and bending unit 78 as known from the exemplary U.S. Pat. No. 5,105,641.

The endless wire 18 delivered by the intake rollers 24 and CNC controlled by the second servomotor 34 by way of the toothed belt transmission 36 and the intake housing 22, is turned through a predetermined angle and at the right moment, optionally simultaneously with the feeding of the wire 18 by the intake rollers 24, into the most suitable position in space for carrying out the next operating step for each individual section of the wire shaping operation.

Simultaneously with the wire turning by the rotatable wire intake device 10, when the 'rotating wire intake' and the 'rotating wire guide' run synchronously, the wire holder 52 is turned into the most suitable position for the shaping process by CNC activation of the third controllable servomotor 70. At the same time the programmably controlled and power controlled wire brake device 114 can be put into operation by activating the CNC controllable servomotor 152. The amount of brake force transmitted by the pressure bolt 128 onto the wire 18 is predetermined by the CNC machine control depending on the respective shaping process.

What is claimed is:

1. An apparatus for shaping wire into wire products having a wire guide and a wire intake device at an inlet of the wire guide, the wire intake device having clamping parts which clamp the wire, the clamping parts together with the wire guide and the wire being rotatable about a wire axis; the apparatus further having at an outlet of the wire guide a wire holder for forwardly guiding the wire from the wire guide as it moves therethrough, said wire holder being located on a cantilever, said wire holder and said cantilever being movable in a circle around the wire axis, and said wire holder cooperating at its outlet with a cutting tool moving transversely to the wire axis, wherein the movement of the wire in its lengthwise direction and the rotation of the wire about its lengthwise axis as well as the circular movement of the cantilever and the wire holder about the wire axis are programmably controlled and coordinated with each other.

2. The apparatus of claim 1, wherein the cantilever has a flange mounted on a machine frame, the flange is rotated about the wire axis by a flange drive under program control.

3. The apparatus of claim 2, further comprising a rotatable shaft arranged adjacent an outlet of the wire holder, a longitudinal and rotational axis of the shaft being close to a path of the wire outside the wire holder, the shaft having a tool holder at the free end of the shaft bearing at least one tool to guide the wire into a shape, and rotation and displacement of the shaft relative to the path of the wire are programmably controllable.

4. The apparatus of claim 1, further comprising a rotatable shaft arranged adjacent an outlet of the wire holder, a longitudinal and rotational axis of the shaft being close to a path of the wire outside the wire holder, the shaft having a tool holder at the free end of the shaft bearing at least one tool to guide the wire into a shape, and rotation and displacement of the shaft relative to the path of the wire are programmably controllable.

5. The apparatus of claim 1, wherein feeding of the wire and rotation of the wire intake device are effected under program control.

6. An apparatus for shaping wire as the wire generally moves between an upstream end of the apparatus and a downstream end of the apparatus, the apparatus comprising:

a wire intake device rotatable about a wire axis, the wire intake device having clamping parts for engaging a wire therebetween and advancing, retracting and rotating the wire;

a wire holder downstream of the wire intake device for guiding and supporting the wire as it moves therethrough; and a cantilever supporting the wire holder at a distal end thereof, the cantilever being rotatable about the wire axis; and a control assembly selectively controlling the wire intake device to advance, retract and rotate the wire, and selectively controlling rotation of the cantilever and wire holder.

7. An apparatus of claim 6, further comprising a wire guide positioned between the wire intake device and the wire holder to guide the wire therebetween, the wire guide being rotatable about the wire axis.

8. An apparatus of claim 6, further comprising a tool movable in a direction transverse to the wire axis, the control assembly selectively controlling the movement of the tool and the cantilever to cooperatively interact with the wire at an outlet of the wire holder.

9. A method for shaping wire, comprising:

providing an apparatus for shaping wire that includes a wire intake device having clamping parts for engaging a wire therebetween and advancing, retracting and rotating the wire, a wire holder downstream of the wire intake device for guiding and supporting the wire as it moves therethrough, and a cantilever supporting the wire holder at a distal end thereof, the cantilever being rotatable about the wire axis;

selectively moving the wire generally parallel to the wire axis in either a forward direction or a reverse direction opposite the forward direction using the wire intake device;

selectively rotating the wire about the wire axis using the wire intake device;

selectively rotating the wire support about the wire axis; and automatically coordinating the moving and rotating steps to shape the wire at an outlet of the wire support.

* * * * *